US006585126B1

(12) United States Patent
Grigsby, Sr. et al.

(10) Patent No.: US 6,585,126 B1
(45) Date of Patent: Jul. 1, 2003

(54) RETURNABLE CRATE

(75) Inventors: John M. Grigsby, Sr., Marietta, GA (US); John M. Grigsby, Jr., Woodstock, GA (US); Carl D. Prentice, Douglasville, GA (US); Pete Darmer, Atlanta, GA (US)

(73) Assignee: North American Container Corporation, Mableton, GA (US)

( * ) Notice: Subject to any disclaimer, the term of this patent is extended or adjusted under 35 U.S.C. 154(b) by 0 days.

(21) Appl. No.: 10/015,413

(22) Filed: Dec. 11, 2001

(51) Int. Cl.[7] ..... B65D 8/14

(52) U.S. Cl. ..... 220/6; 220/1.5; 220/7; 206/600

(58) Field of Search ..... 220/1.5, 6, 7; 206/600; 108/56.1

(56) References Cited

U.S. PATENT DOCUMENTS

| | | | | |
|---|---|---|---|---|
| 2,276,495 A | | 3/1942 | Kenfield | |
| 2,488,692 A | | 11/1949 | Talbot | |
| 2,498,414 A | * | 2/1950 | Gondar | 220/8 |
| 2,965,276 A | | 12/1960 | Foster | |
| 3,499,398 A | * | 3/1970 | Murray | 108/53.5 |
| 3,620,388 A | * | 11/1971 | Mansson | 108/53.1 |
| 4,832,256 A | | 5/1989 | Grigsby | |
| 5,810,186 A | * | 9/1998 | Lam | 220/1.5 |
| 6,142,329 A | * | 11/2000 | Dotan | 220/4.33 |
| 6,227,397 B1 | * | 5/2001 | Kim | 220/8 |

FOREIGN PATENT DOCUMENTS

FR 1265313 5/1961

OTHER PUBLICATIONS

Introducing Load Hog, V/Core pamphlet, North American Container Corporation, 5851 Riverview Road, Mableton, GA 30059.

Wood–Cleated Corrugated brochure, North American Container Corporation, 5851 Riverview Road, Mableton, GA 30059.

* cited by examiner

*Primary Examiner*—Stephen K. Cronin
*Assistant Examiner*—Joseph C. Merek
(74) *Attorney, Agent, or Firm*—Baker, Donelson, Bearman & Caldwell

(57) ABSTRACT

A returnable crate (10) for heavy durable goods in which a base frame (12) includes stringers (20, 22) secured together by slats (24, 26) and a pair of opposing end frame assemblies (14, 16) that have posts (48) that pivotally connect to respective distal ends of the stringers. Locking collars (90) are slidably received on the posts (48) and move between a locking position and a pivoting position. The locking collars hold the end frame assemblies (14, 16) in a set-up position extending substantially perpendicularly from the base frame (12) and a pivoted position with the end frame assemblies folded down towards the base frame. Side diagonals (58) connect between pivot brackets (52) and the posts (48) in the end frame assemblies (14, 16). The locking collars (90) and side members (58) hold the end frame assemblies (14, 16) in the set-up configuration for shipment of the heavy durable good. The locking collars (90) being moved to the second position allow the end frame assemblies (14, 16) to pivot to the knock-down configuration with the side members (58) being pivotally crossed across the base frame (12) for return shipment of the crate (10).

29 Claims, 4 Drawing Sheets

RETURNABLE CRATE

TECHNICAL FIELD

The present invention relates to containers for heavy durable goods. More particularly, the present invention relates to a container having pivotable opposing ends for a package to handle, store, and ship heavy durable goods such as lawn and garden tractors, motorcycles, all terrain vehicles, watercraft, and the like, which container readily changes between a setup extended configuration for use and a knock-down configuration for return shipment of the container to a manufacturer of durable goods for reuse with such goods.

BACKGROUND OF THE PRESENT INVENTION

Heavy durable goods such as lawn and garden tractors, motorcycles, all terrain vehicles, watercraft, and the like typically are packaged for handling, storage, and shipping in single unit containers. One type of single-unit container for packaging such heavy durable goods is a top-frame, cleat-reinforced corrugated paperboard container. The durable goods mount to a pallet which is then enclosed by a corrugated paperboard body. A plurality of vertical reinforcement cleats attach to at least two opposing interior walls of the corrugated paperboard body. The corrugated paperboard body provides definition for the container, protects the durable goods within the container from damage and dust, and maintains the position of the reinforcement cleats. The upper ends of the reinforcement cleats receive a top frame that communicates loading forces through the vertical reinforcement cleats to the pallet. Typically, flaps on the corrugated paperboard body fold over from an upper edge to close the container, although a separate cap may also be used to close the container.

Such corrugated paperboard containers typically are single use, in that after the container is shipped to a sales facility and opened, the container is typically discarded. The corrugated paperboard body readily recycles conventionally. However, most wood components, such as the pallet and top frame typically are discarded in landfills. In use, these containers adequately enclose, support, and protect the goods during handling, storage and shipping. The container costs, however, must be kept relatively low. Manufacturers generally view container packaging as a necessary item, but as not providing a recognized value to the consumer.

Various factors are leading to changes in the packaging industry for such heavy durable goods. These changes are induced by the perceived costs for single use corrugated paperboard containers. While the corrugated paperboard generally can be separated and recycled, the other components often made of wood, such as the pallet, top frame, and the reinforcement cleats, often are disposed of in landfills. Increased environmental concerns are limiting the use of landfills for disposal of these types of articles.

As an alternative to single use containers, some manufacturers of heavy durable goods are using returnable containers. One such returnable container for heavy durable goods is manufactured with steel framing members. The pallet or base of the container includes projecting lugs at the corners. The lugs receive end panels. The pallet and the end panels interlock with detachable pins.

While these types of returnable container have met with some acceptance, there are drawbacks to their use. The end panels must be held while the side members are installed.

The connections permit the end panels to move laterally, which lessens the structural rigidity of the container and restricts the containers from stacked loading for storage in warehouses or in trucks for shipping.

These containers however typically have a number of loose pins and detachable separate components which often are lost and not returned with the returned container. This results in all of the parts not be available when the returned container is placed on the assembly line of the manufacturer for re-use. To avoid a line stoppage, the returned containers must be inspected and damaged parts repaired or replaced and missing parts provided from an inventory of spare components.

Handling of these containers also causes problems. Handling is typically accomplished using lift trucks such as those having extending fork blades or those having parallel clamp platens. Lift truck operators often align or move the containers for lifting using the fork blades or the clamp platens to push against the container. Pushing or contacting the lower corners of the containers may damage the brackets to which the end panels connect. Damaged or bent brackets cause difficulties with allowing the end panels to pivot or to be removed. Damaged brackets must be repaired or replaced.

Accordingly, there is a need in the art for an improved returnable container with a reduced number of detachable components as practical for packaging heavy durable goods. It is to such that the present invention is directed.

SUMMARY OF THE PRESENT INVENTION

The present invention provides an improved returnable crate for packaging heavy durable goods for handling, storing, and shipping, comprising a base frame suitable for supporting a heavy durable good to be packed, the base frame including a pair of spaced-apart stringers secured by at least a pair of end slats attached at opposing distal ends of the stringers. A pair of opposing end frame assemblies each have a pair of posts pivotally connected at a first end to a respective first pivot bracket rigidly connected to a respective distal end of the stringers. A locking collar slidably received at a lower end of each post is movable between a first position about the connection of the post and the first pivot bracket and a second position spaced apart from said connection. The end frame assembly moves from a knock-down configuration with the end frame assembly folded down towards the base frame and a set-up configuration with the end frame assembly extending substantially perpendicularly from the base frame. The locking collars move to the first position to restrict pivoting and to protect the end frame assembly and to the second position to permit pivoting. A pair of side members connect at a first end to a second pivot bracket attached to a respective one of the stringers spaced apart from the first pivot bracket and detachably connected at an opposing distal end to an upper portion of the post. Each side member is moveable from a first position connected to the post and a second position pivoted with the opposing distal end towards the opposing second pivot bracket. The locking collars and side members in respective first positions hold the end frame assemblies in the set-up configuration for shipment of the heavy durable good. The locking collars move to the second position to pivot the end frame assembly to the knock-down configuration with the side members being moved to the second position for return shipment of the crate without the heavy durable good.

Objects, features, and advantages of the present invention will become apparent from a reading of the following detailed description of the invention and claims in view of the appended drawings.

DETAILED DESCRIPTION OF THE PREFERRED EMBODIMENTS

Figure 1:
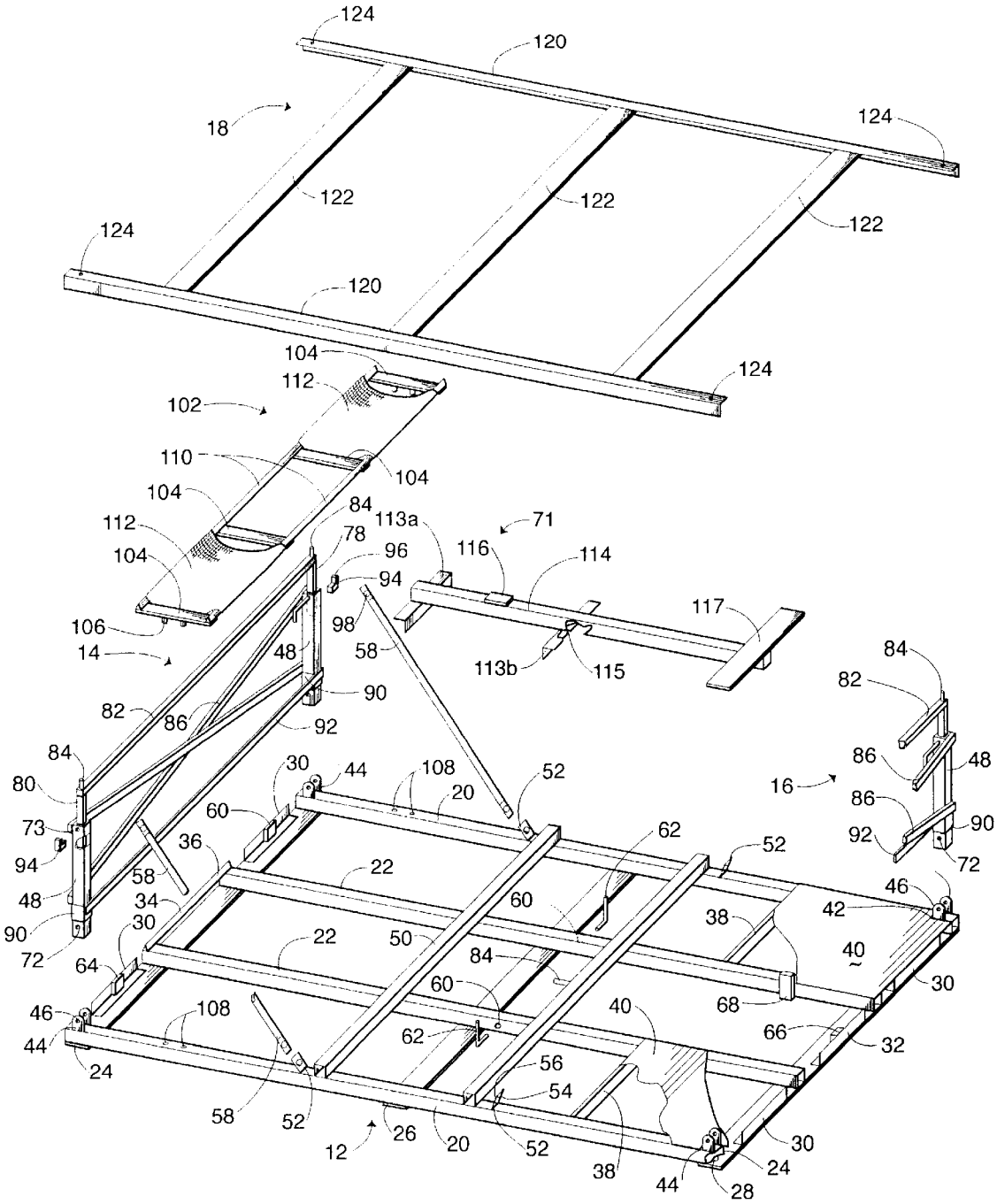
FIG. 1 is a perspective, partially cut-away, exploded view of a returnable crate according to the present invention.

Referring now in more detail to the drawings, in which like numerals indicate like parts throughout the several views, there is shown in perspective, partially cut-away, exploded view a returnable crate 10 in accordance with the present invention. The returnable crate 10 includes a pallet or base generally 12 having a pair of opposing end frame assemblies 14, 16 (the end frame assembly 16 illustrated in partial view but identical in structure to the end frame assembly 14), and a top frame 18.

The base 12 includes a pair of outside stringers 20 and a pair of spaced-apart parallel inside stringers 22. The outside stringers 20 are elongate steel tubes, while the inside stringers 22 are C-channels disposed with their open faces in opposing relation. The stringers 20, 22 are connected together by a pair of end bottom slats 24 and an intermediate bottom slat 26. The slats 24, 26 are flat steel members. As illustrated in cut-away view, the opposing distal end portions of the end bottom slats 24 define holes 28. The holes 28 are punched with a tapered counter-recess to define a receiving socket, for a purpose discussed below.

Angle members 30 rigidly connect to the end bottom slats 24 between the respective outside stringers 20 and inside stringers 22. A center filler 32, also an angle member, rigidly attaches to the end bottom slat 24 at one end (the "rear" end) of the base 12. (The rear end portion of the base 12 is configured in the illustrated embodiment for supporting a back or rear of a wheeled vehicle to be packaged in the returnable crate 10. The opposing end is configured for supporting a front portion of the wheeled vehicle.)

The opposing end of the base 12 is open between the inside stringers 22, for insertion of extending forks of a fork lift truck for lifting the returnable crate 10 during shipping, storage, and handling. This opening however, is covered by a fork front plate 34 that attaches to the upper surfaces of the interior stringers 22. A plate stiffener 36, an inverted angle member preferably with rounded corners, attaches rigidly to an upper surface of the front plate 34. Generally the plate 34 and the plate stiffener 36 are positioned on the end of the base 12 associated with the front portion of the vehicle to be packed in the crate, while the center filler 32 is placed in the end of the base associated with the rear or back portion of the vehicle to be packaged in the crate 10. The center filler 32 prevents a fork lift operator from inadvertently trying to pick up the pallet from an incorrect end of the crate 10 so that the crate and its contents are less likely to tumble off of the fork lift truck during handling.

A pair of angle members 38 connect between the opposing pairs of the outside stringer 20 and the inside stringer 22. The angle members 38 are spaced-apart from the respective corner fillers 30 and define an interior edge supports for respective rear tire plates 40 mounted to upper surfaces of the stringers 20, 22. The upper edge of the corner fillers 30 support the end edge of the plates 40, as illustrated in partial cut-away view. The plates 40 are steel sheets. The plates 40 define respective notches 42 whereby a post pivot bracket 44 extends upwardly from the respective distal ends of the outside stringers 20. The post pivot brackets 44 are U-shaped members rigidly connected to the distal end portions of the outside stringers 20. The opposing legs of the pivot brackets 44 define aligned holes 46 for receiving a locking pin to secure a post 48 of the respective end frame assemblies 14, 16 as discussed below.

A pair of fork channels 50 defined by U-shaped channel members mount transverse to longitudinal axis of the stringers 20, 22 and spaced-apart from the intermediate bottom slat 26. Side diagonal pivot brackets 52 rigidly connect to the upper surfaces of the outside stringers 20 adjacent the fork channels 50. The side diagonal pivot brackets 52 are flat stock stamped members having a portion in contacting engagement with the respective stringer 20 and an upwardly angled portion 54 that defines a hole 56 for receiving a bolt, as discussed below to secure a side diagonal 58 of the respective end frame assemblies 14, 16. The side diagonals 58 are preferably round tubular members.

In the illustrated embodiment, a face of the respective inside stringers 22 each define at least one hole 60. The hole 60 receives a hook-end of a J-hook 62. The opposing end of the J-hook is threaded for receiving a nut for rigidly connecting a vehicle (or other article to be packaged) to the base 12 of the returnable crate 10. It is to be appreciated that the hole 60 receiving the J-hook 62 is selectively positioned depending upon the structure of the vehicle or other article to be packed within the returnable crate 10.

A pair of front tire protectors 64, each defined by a tubular member, mount to the corner filler 30 at the front end of the base 12 for providing a stop or protection to the front tires of the vehicle held on the base 12. In the illustrated embodiment, the opposing rear-end includes a pair of return tubes 66, 68. A first return tube 66 mounts to the center filler 32 while a second return tube 68 mounts to the face of one of the inside stringers 22, for a purpose discussed below. An alignment pin 70 projects from a side face of one of the floor channels 50 intermediate the outside stringers 20. The alignment pin 70 facilitates aligning a support frame 71 (discussed below) on the base 12. The pin 70 preferably has a beveled distal end.

In the illustrated embodiment, the end frames 14, 16 are identical and disposed in opposing relation at the front and rear ends of the base 12. This facilitates standardization of parts, manufacture, and assembly of the container 10. However, as discussed below, the end frames 14, 16 may differ. Continuing with the illustrated embodiment, the end frame assembly 14 includes a pair of the posts 48 which each define in a bottom portion aligned holes 72. The posts 48 should be of a material (typically steel) of sufficient gauge and size as to allow several of the containers 10 to be stacked, for example in trucking and warehousing. Often the manufacturer or customers have warehouses that allow stacking heights of six or more units high. For example, stacking six containers each with an "all terrain vehicle" weighing some 700 pounds results in the bottom unit having a top load of 3500 pounds. Generally, containers are manufactured with a safety factor, typically 4:1, so that the containers 10 are designed to support four times this load, or 14,000 pounds, or approximately 3,500 pounds per post for a container with four posts 48. The posts 48 must therefore be sized to sustain the projected top load due to stacking. For additional top load capacity, a center post can be added on at least two opposing sides, which has the additional benefit of reducing the length span between the posts and thereby reducing the bending moment of the base stringers 20, 22 when the container 10 is lifted by a fork truck.

The post 48 receives a pin (such as a bolt and nut) for connecting the post 48 to the post pivot bracket 44. The post 48 also defines openings 73 in an upper portion for cooperating with a locking member generally 76 to engage an end of the side diagonal 58. The upper end of the post 48 telescopically receives an extension tube 78. The extension tube 78 includes a plurality of spaced-apart holes 80 (one of which is illustrated) for selectively positioning the extension tube relative to the upper end of the post 48. The extension tube 78 is secured to the post 48 by the locking member 76. An angle member 82 connects to the upper ends of the extension tubes 78. A locating pin 84 projects upwardly from each of the extension tubes 78, for a purpose discussed below. Diagonal cross members 86 interconnect the upper and lower ends of the opposing posts 48. The cross members 86 are welded together at their crossing.

As noted above, the end frames 14, 16 in the illustrated embodiment are identical. However, differing end frames 14, 16 are contemplated within the scope of the present invention. For example, the shape of the durable good packaged within the container 10 may require differences in the side diagonals 58, in the end diagonals 86, or the addition of plates on the end frame 16 that function as guide tracks for the tires when rolling a motor vehicle out of the container from the end of the container. For example, the side diagonals 58 in an alternate embodiment pivot at the connection with the end frame 14, 16 rather than at the pivot bracket 52.

A tubular lock collar 90 is received on the lower end of each post 48. A tie bar 92 interconnects the opposing lock collars 90. The lock collars 90 are slightly larger than the cross-sectional perimeters of the posts 48. The collars 90 move between a first position aligned at the bottom of the posts 48 around the connection of the post 48 and the pivot bracket 44 and a second position spaced-apart from the bottom of the post 48. With the collars 90 in the second position, the end frame 14 pivots between a folded or knock-down position for return shipment and an extended position for use as a container, as discussed below. With the collars 90 in the first position, the end frame 14 is restricted from pivoting. Further, the locking collars 90 when in the first position, protect the pivot bracket 48 from damage due to contact with the fork blades or clamp platens of material handling trucks. The collars 90 are preferably made from thicker steel than the pivot bracket 48, so that if a lift truck operator attempts to push a loaded crate with the fork blades or clamp platens, the pivot bracket being enclosed by the collar is protected from damage or bending.

The lock collars 90 are loose enough to allow the assembly of the lock collars 90 and the tie bar 92 to move to the first position by gravity but still provide a snug fit on the posts 48. To this end, two of the opposing walls of the lock collars 90 are slightly pressed to provide an inwardly bowed side wall for the snug fit yet still permit movement of the lock collars by gravity to the first position. It is to be appreciated that the lock collars 90 in the first position lock the posts 48 extended substantially perpendicular to the base 12.

A bracket 94 mounts to an outside surface of each of the posts 48 near the opening 73 for a locking pin 134 in the locking member 76. The bracket 94 defines a notch 96 for receiving a flattened distal end of the side diagonal 58. The distal end defines a hole 98 through which a portion of the locking member 76 extends. The notched portion of the bracket 94 supports a portion of the distal end near the hole, whereby the locking member 76 does not push the side diagonal 58 laterally when engaging the locking member. The opposing distal end of the side diagonal 58 has a flattened portion that defines a hole 100. A fastener 101, such as a bolt locked with a nut, passes through the hole 100 and the hole 56 in the side diagonal pivot bracket 52. This connects the side diagonal 58 between the base 12 and the end frame assembly 14. It is to be appreciated that the end frame assembly 16 illustrated in a partial cut-away view on the opposing end of the base 12 is constructed identically to the end frame assembly 14. The respective end frame assemblies 14, 16 thereby define opposing pivotable ends for the returnable crate 10.

The returnable crate 10 includes a cradle 102 illustrated exploded from the base 12 for supporting the front wheels of a vehicle packaged within the returnable crate. The cradle 102 is a rigid frame made from parallel bottom slats 104 spaced-apart to align with the outside and inside stringers 20, 22. A pin 106 projects downwardly from each of the outwardly disposed slats 104. The pins 106 engage selected aligned openings 108 in the upper surfaces of the outside stringers 20, whereby the cradle 102 is fixed to the base 12. A plurality of the aligned openings 108 are spaced-apart longitudinally, for selective positioning of the cradle 102. A pair of inverted angle members 110 extend transverse to the slats 104 and rigidly connect in spaced-apart relation for securing the cradle 102 together. A pair of wheel pans 112 connect between the opposing angle members 110 and are curved to a radius that conforms to the diameter of the tires of the vehicle to be packaged in the returnable crate 10.

In the illustrated embodiment, the support frame 71 provides optional support for a transmission of the vehicle to be packaged in the returnable crate 10, if necessary. The support frame 71 includes a pair of angle members 113*a*, 113*b* mounted in opposing relation to an elongate tube 114. The angle members 113*a*, 113*b* are spaced to be received on the fork channels 50. The angle member 113*b* defines a notch 115 that receives the alignment pin 84 when seating the support frame 71. Rubber pads 116, 117 mount to upper surfaces of the support frame 71 for bearing contact with portions of the article to be packaged in the returnable crate 10, for example, supporting a transmission in a motorized vehicle.

The top frame 18 optionally caps the returnable crate 10 during shipping, handling, and storage, particularly for providing increased rigidity and racking strength when returnable crates are stacked together. The top frame 18 assembles from a pair of spaced-apart angle members 120 interconnected by three spaced-apart transverse members 122. Opposing distal ends of the members 120 define holes 124 which receive the pins 84 projecting upwardly from the extension tubes 78.

Figure 2:
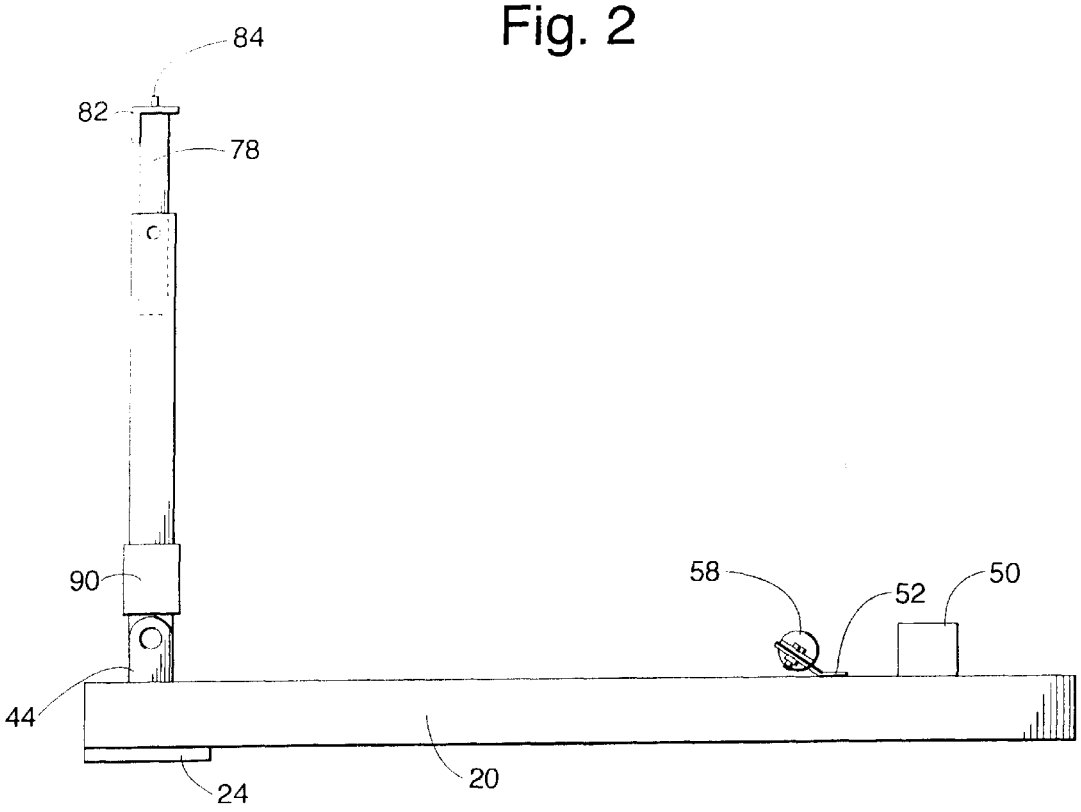
FIG. 2 is a side view of a portion of the returnable crate illustrated in FIG. 1.

FIG. 2 is a side view of a portion of the returnable crate 10, and particularly illustrates the lock collar 90 in the second raised position prior to pivoting the end frame 14 to a knock-down position for return shipment of the returnable crate 10 to a manufacturer of goods packaged on the returnable crate. The side diagonal 58 is pivoted down to a transverse crossing position across the upper surfaces of the stringers 20, 22.

Figure 3:
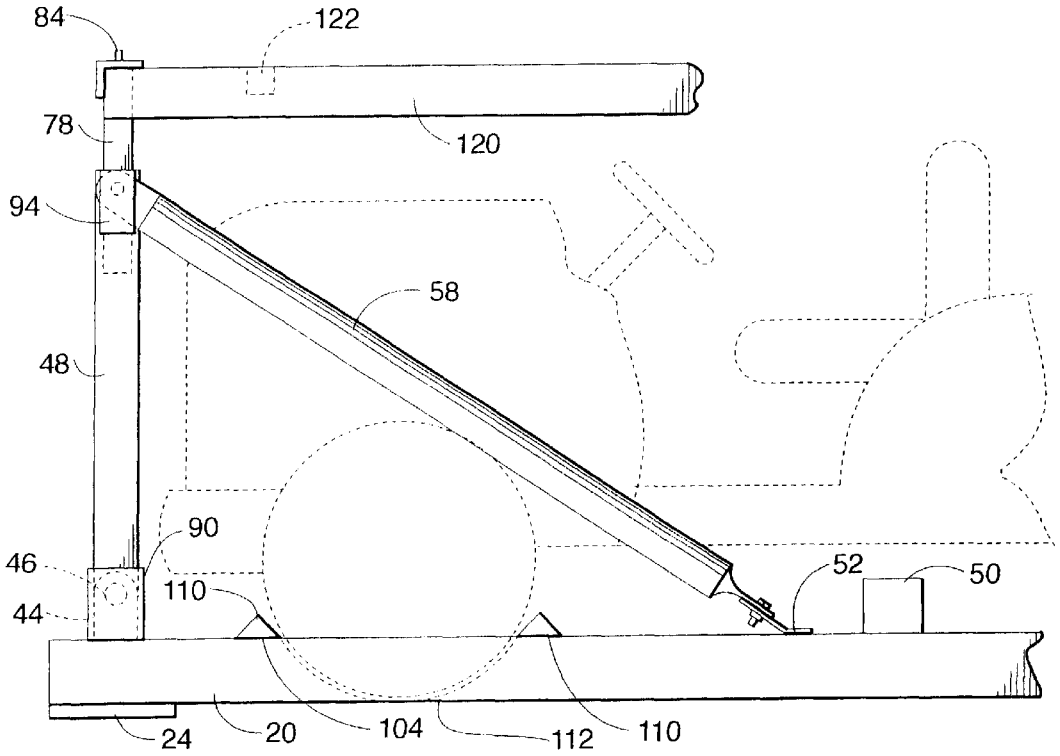
FIG. 3 is a side view of the portion of the returnable crate illustrated in FIG. 1 in the set-up position.

FIG. 3 is a side view of a portion of the returnable crate 10, illustrating the crate in its setup position for packaging a vehicle (illustrated in phantom) on the base 12. The lock collar 90 is in its first position which locks the posts 48 from pivotal movement about the pin in the pivot bracket 44. Further, the side diagonal 58 is secured by the locking member 76 and by the bolt through the side diagonal pivot bracket 52. The cradle 102 is positioned on the stringers 20, 22 with the wheel pans 112 for receiving wheels of the vehicle to be packed. It is to be appreciated that a different cradle may be used, depending upon the particular article to be packed; for example, a water craft would not require the wheel pans 112.

Figure 4:
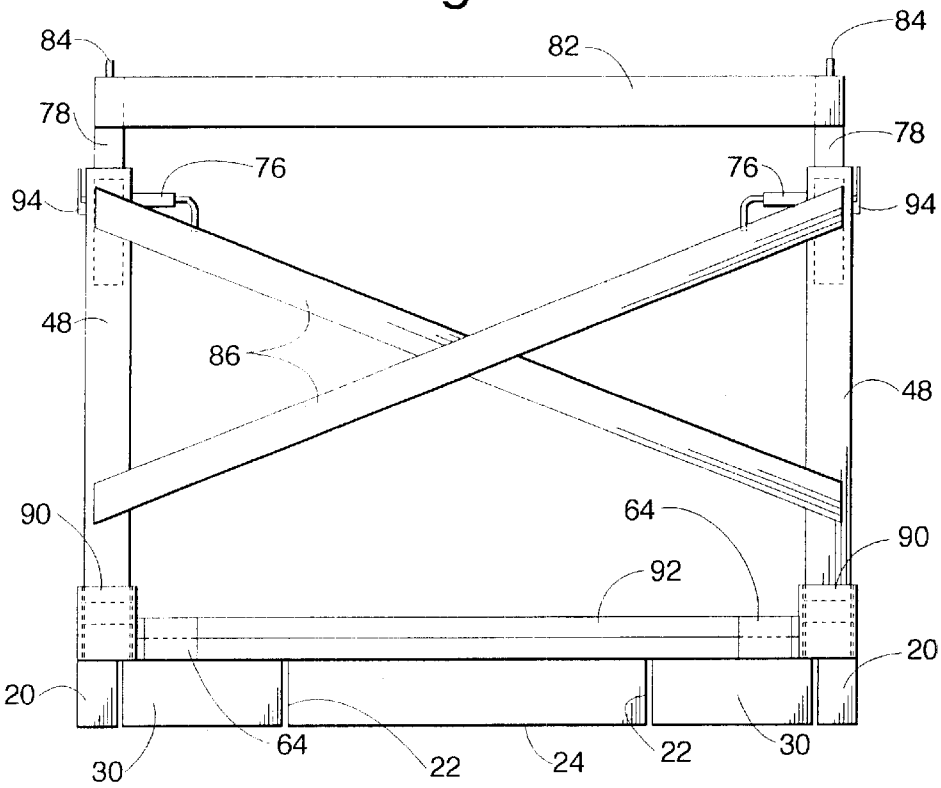
FIG. 4 is an end view of the returnable crate illustrated in FIG. 1.

FIG. 4 is an end view of the returnable crate 10, illustrating the crate in its setup position for packaging a vehicle on the base 12. The lock collars 90 are in the first position which locks the posts 48 from pivotal movement relative to the pivot brackets 44. The end slat 24 and the front plate 34 cooperate with the interior stringers 22 to define the opening 118 for passage of the forks of a forklift truck to move the returnable crate 10.

Figure 5:
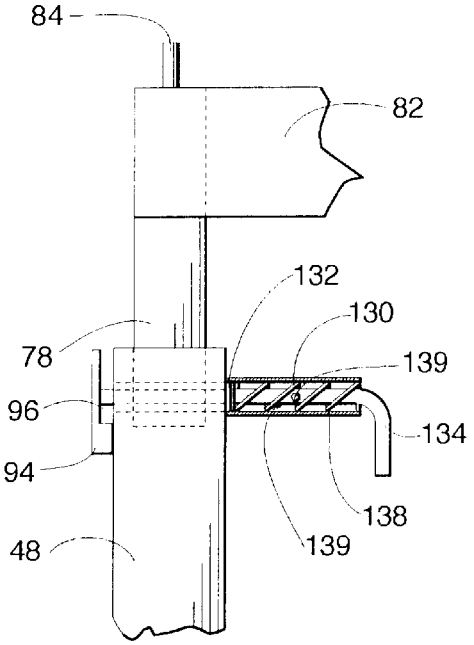
FIG. 5 is a detailed view of a lock assembly in the locked position for holding the extension posts of the returnable crate illustrated in FIG. 1.

FIG. 5 is a detailed view of the upper portion of the posts 48 illustrating the locking member 76 in a locked position. The locking member 76 includes a housing 130 that includes a spacer tube 132 at a first end. The spacer tube 132 defines a bore through which a distal portion 135 of the locking pin 134 extends. through the opening 73 in the post 48 to engage the hole 98 in the side diagonal 58. The bore provides alignment as the distal portion 135 of the locking pin 134 travels between the locked position and an unlocked position. A roll pin 136 extends through a bore in the locking pin 134 to stop the return travel of the locking pin within the housing 130. A spring 138 biases the locking pin 134 to the locked position. The distal end 135 of the locking pin 134 passes through aligned openings in the extension posts 78 and the post 48 to engage the opening 98 in the side diagonal 58 of (best illustrated in FIGS. 2 and 3). The locking pin 134 includes a pair of projecting tabs 139 which are radially offset. The inner faces of the extension post 78 and the post 48 as well as the face of the housing 130 define a keyhole type opening to allow passage of the tabs 139.

Figure 6:
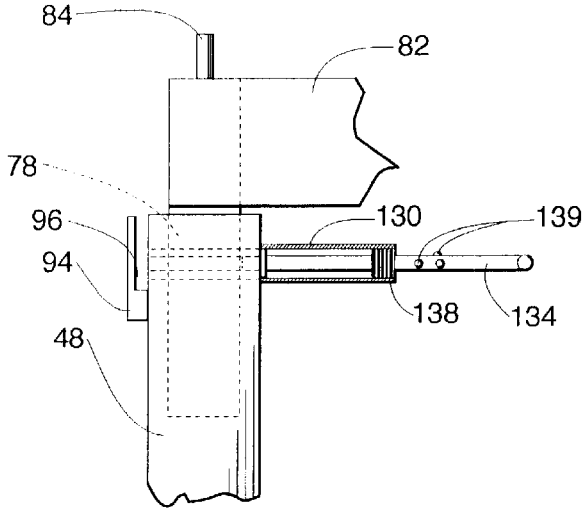
FIG. 6 is a detailed view of the lock assembly in the unlocked position for moving the extension posts in the returnable crate illustrated in FIG. 1.

FIG. 6 is a side view of the locking member 76 in the release position. The spring 138 is compressed against the roll pin 136 as the locking pin 134 is moved laterally from the housing 130. The distal end 138 is retracted from the posts 78 and 48 thereby allowing the post 78 to move within the post 48. This also releases the engagement of the side diagonal 58. Upon release of the side diagonal 58, the diagonal may be pivoted about the side diagonal pivot bracket 52 toward the opposing side bracket, as illustrated in FIG. 2. The pair of side diagonals 58 accordingly pivot downwardly to the stringers 20, 22 and cross for return shipment of the returnable crate 10.

Figure 7:
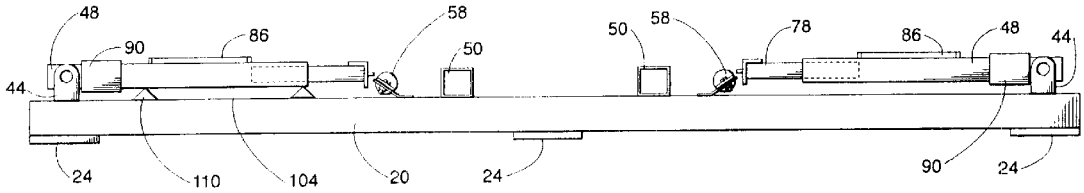
FIG. 7 is a side view of the crate shown in FIG. 1, in the knock-down position for return shipment.

FIG. 7 is a side view of the returnable crate 10 in its knock-down position ready for return shipment to a manufacturer using the crate for shipping its durable goods. The lock collars 90 are in the second position, with the side diagonals 58 pivoted to the lowered positions.

It is to be appreciated that the extension tubes 78 allow durable goods of differing heights to be packed in the same container 10. For example, a smaller yard tractor may have a height that permits the top frame to be installed with the extension tubes 78 in the retracted position. Containers of smaller yard tractors may then be stacked three containers high for trucking or warehousing. A larger tractor however may have a height requiring the extension tubes to be fully extended, and the containers may be stackable two units high. Accordingly, the length of the extension tubes 78 are sized depending upon the various heights of the durable goods to be packaged. However, the extension tube 78 must be of a length less than the length of the post 48 less the distance between the bottom of the pivot bracket 44 and the opening 46, so that the extension tube will telescope fully into the post 48 to the lowest position for knocking down the container 10 for return and reuse. Preferably, the total collapsed height of the end frame 14, 16 must be less than one-half the length of the base 12. This permits the end frames 14, 16 to fold over substantially flat on the base 12 without overlap of the end frames. Overlap prevents the knocked-down container 10 from being essentially flat across the upper surface, which interferes with stacking other knocked-down containers on top of each other for return shipment and storage prior to re-use. In an alternate embodiment of the container 10, the frame 14 includes the telescoping members 78, while the opposing end frame 16 is full height, which facilitates readily assembling and disassembling the container. The folded-over end frames 14, 16 also hold the cradle 102 and optional support frame 71 to the base 12 for return shipment to the manufacturer for reuse.

The returnable crate 10 is gainfully used for packaging heavy durable goods, such as lawn and garden tractors, all terrain motorized vehicles, watercraft, motorcycles, and the like, for handling, storage, and shipment. The illustrated embodiment is particularly configured for shipping four-wheel all-terrain vehicles. With reference to FIG. 7 and FIG. 1, the returnable crate 10 is prepared for use by pivoting the end frame assemblies 14, 16 on the pivot brackets 44 from the folded or knocked-down position to the vertical setup position. The side diagonals 58 pivot on the pivot bracket 52 from the lowered position to a raised position extending at an angle to the post 48, as illustrated in FIGS. 2 and 3. The distal end of the diagonal 58 is received in the notch 96 adjacent the opening in the upper end of the post 48.

With reference to FIGS. 5 and 6, the locking member 76 is actuated to lock the side diagonals 58 to the posts 48. The locking pin 134 is grasped and rotated 90° (see FIG. 6) and then retracted from the housing 130, thereby compressing the biasing spring 138. This allows the tabs 139 to pass through the keyhole openings. A second 90° rotation allows the locking pin 134 to be fully retracted. Return rotation positions the adjacent tab 139 out of alignment with the key of the opening, so that the locking pin 134 is held of engagement with the extension tube 78. The extension tube 78 is then telescopically moved relative to the post 48 to a selected height for the crate 10. The locking pin 134 is then returned to the locking position by rotation to pass the tabs 139 through the keyhole openings. The distal end 135 passes outwardly of the post 48 and through the hole 98 in the side diagonal 58. The bracket 94 prevents the side diagonal 58 from moving laterally as the locking pin 134 engages.

The lock collars 90 move from the retracted position to the locking position, best illustrated in FIGS. 3 and 4. The locking collars 90 prevent the post 48 from pivotal movement about the pivot bracket 44. The cradle 102 is inserted. This is accomplished by positioning the pins 106 in one of the selected holes 108 in the outside stringers 20. The support frame 71 is received in the base 12 by placing the angle members 113, 114 on the respective fork channels 50 and the alignment pin 70 in the notch 115. The front wheels of the all terrain vehicle are received in the wheel pans 112 while the rear wheels are supported on the rear tire plates 40. The J-hooks 62 are received in the holes 60 and extended upwardly. Appropriate fasteners connect the J-hooks 62 to portions of the vehicle carried on the base 12. The rubber pads 116, 117 cushionly bear against portions of the vehicle.

The top frame 18 is installed as an option. The holes 124 receive the pins 84 extending from the end frame assemblies 14, 16. The top frame provides racking strength as well as the frame work for providing plastic sheeting or other enclosures for the durable good contained on the base 12. The top frame 18 also protects the durable goods in the crate 10, in the event smaller packages are placed on top, as is often the case in mixed or less-than-truckload (LTL) shipments. It is noted that he end bottom slats include the holes 28. This facilitates positioning a second one of the returnable crates 10 on top of another by the pins 84 of the lower crate being received in the holes 28 of the upper crate.

The crate 10 may then be handled by fork lift trucks. The forks of the fork lift truck extend into the base 12 through the opening defined between the front plate 34 and the end slat 24. The plate stiffener 36 provides structural rigidity for resisting the load imposed by the returnable crate 10 and its contents on the forks of the fork lift truck. Further, the fork channels 50 provide bearing surfaces inwardly of the base 12 and prevent the forks of the fork lift truck from pivoting upwardly and damaging the durable good contained on the base.

Upon delivery, the durable good is removed from the returnable crate 10. This is accomplished by disengaging the top frame 18 (if used) or unstacking a multi-tier group of the returnable crates 10. The fasteners securing the J-hooks 62 to the durable good are released and the durable good removed. For rolling vehicles, slots formed in the end slat 22 permit the pallet to engage ramps, which facilitates rolling the vehicle off of the base frame 12. In an alternate embodiment, a U-shaped bracket attached to an outer face of the corner fillers 30 in the rear portion of the base frame 12 to facilitate moving the vehicle off of the base frame.

The returnable crate 10 is then prepared for return shipment. The lock collars 90 are moved from the locking position to the pivot position, as illustrated in FIGS. 4 and 3. The locking members 76 are operated to retract the locking pins 134 from securing the side diagonal 58 to the posts 48. The side diagonals 58 are pivoted about the pivot bracket 52 to the knock-down position, as illustrated in FIG. 2, with the side diagonals 58 crossing each other and laying against the upper surfaces of the stringers 20, 22. The lock collars 90, elevated as shown in FIG. 2, enable the end frame assembly 14, 16 to pivot relative to the post pivot brackets 44 to the collapsed or knock-down position as illustrated in FIG. 7. The end frame assembly 14 holds the cradle 102 in position against the base 12 and the end frame 16 holds the support frame 71. The end frame assemblies 14, 16 can be strapped to secure them in their folded position.

The present invention accordingly provides the improved returnable container 10 having as few detachable parts as practical. The opposing end frames 14, 16 and side diagonals 58 hingedly connect to the base 12 to facilitate moving between the extended position for use and the knocked-down position for readily returning the container 10 for reuse. The locking collars 90 selectively position for pivoting the opposing end frames 14, 16 while being biased to the lowered position for preventing pivoting and for protecting the pivotable connections of the end frames 14, 16 and the base 12 during shipment and handling of the container 10. The movable front cradle 102 engages positioning holes 108 in the base 12 in order to selectively support different sized durable goods in the container 10. The front cradle 102 is held to the base 12 by the folded-over end frame 14 for return with the container 10 for reuse. The spring-biased locks 76 for the telescoping extension tubes 78 control inadvertent release, such as during shipment and handling and thereby prevent attendant loss of racking strength of the container while also facilitating the telescoping movement of the extension tubes between the collapsed and extended positions.

The principles, preferred embodiments, and modes of operation of the present invention have been described in the foregoing specification. The invention is not to be construed as limited to the particular forms disclosed because these are regarded as illustrative rather than restrictive. Moreover, variations and changes may be made by those skilled in the art without departure from the spirit of the invention as described by the following claims.

What is claimed is:

1. A returnable crate for handling, storing, and shipping heavy durable goods, comprising:

a base frame suitable for supporting a heavy durable good to be packed, said base frame including a pair of spaced-apart stringers secured by at least a pair of end slats attached at opposing distal ends of the stringers;

a pair of opposing end frame assemblies, each end frame assembly comprising a pair of posts pivotally connected at a first end to a respective first pivot bracket that is rigidly connected to a respective distal end of the stringers;

a locking collar slidably received at a lower end of each post, movable between a first position about the connection of the post and the first pivot bracket and a second position spaced apart from said connection;

the end frame assembly pivotally movable from a knock-down configuration with the end frame assembly folded down towards the base frame and a set-up configuration with the end frame assembly extending substantially perpendicularly from the base frame, the locking collars being moved to the first position to restrict pivoting of the end frame assembly and to the second position to permit said pivoting;

a pair of side members, each connected at a first end to a second pivot bracket attached to a respective one of the stringers spaced apart from the first pivot bracket and detachably connected at an opposing distal end to an upper portion of the post, the side member moveable from a first position connected to the post and a second position pivoted with the opposing distal end towards the opposing second pivot bracket, whereby the locking collars and side members in respective first positions hold the end frame assemblies in the set-up configuration for shipment of the heavy durable good and the locking collars being moved to the second position to pivot the end frame assembly to the knock-down configuration with the side members being moved to the second position for return shipment of the crate without the heavy durable good.

2. The returnable crate as recited in claim 1, further comprising an elongate member connected at distal ends to the locking collars for the posts in one of the end frame assemblies.

3. The returnable crate as recited in claim 1, further comprising an extension post slidably received in a distal end of each of the posts in at least one end frame and selectively positionable therein, for accommodating larger durable goods.

4. The returnable crate as recited in claim 3, further comprising a holding member to secure the extension post at a selected position relative to the post.

5. The returnable crate as recited in claim 4, wherein the holding member is a pin movable from a securing position to a release position for moving the extension post to a selected position relative to the post.

6. The returnable crate as recited in claim 4, wherein the holding member comprises a pin biased by a spring to a securing position.

7. The returnable crate as recited in claim 6, wherein the pin includes a pair of spaced-apart and radially offset lugs projecting therefrom; and the post defining an opening configured to pass the pin and the lug, whereby the pin must be rotated in order to retract the pin from the securing position so that the extension post can be moved relative to the post.

8. The returnable crate as recited in claim 1, further comprising at least one transverse member spaced apart from the distal ends of the stringers and rigidly connected thereto, whereby forks of a forklike truck extending inwardly from the end bear against the transverse member for handling the crate.

9. The returnable crate as recited in claim 1, further comprising a pair of rear wheel supports and a pair of front wheel supports, for receiving a wheeled vehicle on the base frame.

10. The returnable crate as recited in claim 1, further comprising a cradle having a pair of spaced-apart wheel wells and disposed transverse to a longitudinal axis of the stringers for support thereon.

11. The returnable crate as recited in claim 10, wherein the cradle further comprises:

a plurality of members, each aligned with and supported on a respective one of the stringers;

a pair of spaced-apart elongate transverse members attached to each member; and the wheel wells defined by a pair of pans extending between the transverse members for supporting wheels of the durable good received on the base frame.

12. The returnable crate as recited in claim 11, wherein at least two of the members includes a depending pin; and the stringer defines aligned longitudinally-spaced pairs of openings, whereby the cradle is selectively positioned along a longitudinal axis of the base frame.

13. The returnable crate as recited in claim 1, further comprising a pair of interior stringers disposed between and spaced apart from the stringers.

14. The returnable crate as recited in claim 13, further comprising end plates attached to the end slats between the stringers and the interior stringers to close the base frame from entry of the forks of a fork lift truck.

15. The returnable crate as recited in claim 1, further comprising a top frame received on the end frame assemblies.

16. The returnable crate as recited in claim 15, wherein each post includes a pin projecting from a distal end and the top frame engages the pins in holes defined therein.

17. The returnable crate as recited in claim 1, further comprising a pin projecting from a distal end of each post along a longitudinal axis thereof; and the end slats in the base frame defining openings at distal ends in alignment with the spacing of the pins, whereby a pair of the returnable crates are stackable by receiving the pins of one of the pair of crates in the openings in the slats of the other of the pair of crates.

18. A returnable crate for handling, storing, and shipping heavy durable goods, comprising:

a base frame suitable for supporting a heavy durable good to be packed, said base frame including a pair of spaced-apart outside stringers and at least one inside stringer secured by at least a pair of end slats attached at opposing distal ends of the stringers;

a pair of opposing end frame assemblies, each end frame assembly comprising a pair of posts interconnected together and each pivotally connected at a first end to a respective first pivot bracket rigidly connected to a respective distal end of the outside stringers;

a locking collar slidably received at a lower end of each post, movable between a first position about the connection of the post and the first pivot bracket and a second position spaced apart from said connection;

a pair of elongate members, each connected to the locking collars for the posts in one of the end frame assemblies;

the end frame assembly pivotally movable from a knock-down configuration with the end frame assembly folded down towards the base frame and a set-up configuration with the end frame assembly extending substantially perpendicularly from the base frame, the locking collars being moved to the first position to restrict pivoting of the end frame assembly and to the second position to permit said pivoting;

a pair of side members, each connected at a first end to a second pivot bracket attached to a respective one of the stringers spaced apart from the first pivot bracket and detachably connected at an opposing distal end to an upper portion of the post, the side member moveable from a first position connected to the post and a second position pivoted with the opposing distal end towards the opposing second pivot bracket, whereby the locking collars and side members in respective first positions hold the end frame assemblies in the set-up configuration for shipment of the heavy durable good and the locking collars being moved to the second position to pivot the end frame assembly to the knock-down configuration with the side members being moved to the second position for return shipment of the crate without the heavy durable good.

19. The returnable crate as recited in claim 18, further comprising an extension post slidably received in a distal end of each of the posts in at least one end frame and selectively positionable therein, for accommodating larger durable goods.

20. The returnable crate as recited in claim 19, further comprising an angle member connected to between the distal ends of the extension posts in each frame member.

21. The returnable crate as recited in claim 19, further comprising:

a pin projecting from a distal end of each post along a longitudinal axis thereof; and the end slats in the base frame defining openings at distal ends in alignment with spacing of the pins, whereby a pair of the returnable crates are stackable by receiving the pins of one of the pair of crates in the openings in the slats of the other of the pair of crates.

22. The returnable crate as recited in claim 19, further comprising a holding member to secure the extension post at a selected position relative to the post.

23. The returnable crate as recited in claim 22 wherein the holding member is a pin movable from a securing position to a release position for moving the extension post to a selected position relative to the post.

24. The returnable crate as recited in claim 22 wherein the holding member comprises a pin biased by a spring to a securing position.

25. The returnable crate as recited in claim 24 wherein the pin includes a pair of spaced-apart and radially offset lugs projecting therefrom; and the post defining an opening configured to pass the pin and the lug, whereby the pin must be rotated in order to retract the pin from the securing position so that the extension post can be moved relative to the post.

26. The returnable crate as recited in claim 18, further comprising a top frame detachably received on the distal ends of the end frame members.

27. The returnable crate as recited in claim 18, further comprising a cradle having a pair of spaced-apart wheel wells and disposed transverse to a longitudinal axis of the stringers for support thereon.

28. The returnable crate as recited in claim 27, wherein the cradle further comprises:

a plurality of members, each aligned with and supported on a respective one of the stringers;

a pair of spaced-apart elongate transverse members attached to each member; and the wheel wells defined by a pair of pans extending between the transverse members for supporting wheels of the durable good received on the base frame.

29. The returnable crate as recited in claim 28, wherein at least two of the members includes a depending pin; and the stringer defines aligned longitudinally-spaced pairs of openings, whereby the cradle is selectively positioned along a longitudinal axis of the base frame.

* * * * *